US005233705A

United States Patent [19]

Coleman et al.

[11] Patent Number: 5,233,705

[45] Date of Patent: Aug. 10, 1993

[54] INFLATABLE RAFT WITH SHOWER

[75] Inventors: Richard V. Coleman; Anita R. Coleman, both of 13839 Gardenland Ave., Bellflower, Calif. 90706

[73] Assignees: Richard V. Coleman; Anita R. Coleman, both of Bellflower, Calif.

[21] Appl. No.: 868,990

[22] Filed: Apr. 15, 1992

[51] Int. Cl.[5] ..... E04H 4/14

[52] U.S. Cl. ..... 4/496; 441/129; 5/928

[58] Field of Search ..... 4/496, 494; 441/129-132; 5/455, 928

[56] References Cited

U.S. PATENT DOCUMENTS

| | | | |
|---|---|---|---|
| 3,509,584 | 5/1970 | Sable | 4/494 X |
| 3,636,944 | 1/1972 | Bryant | 128/66 X |
| 3,688,775 | 9/1972 | Raymann | 5/928 X |
| 4,115,888 | 9/1978 | Sievers | 441/132 X |
| 4,251,959 | 2/1981 | Hsu | 441/129 X |
| 4,754,502 | 7/1988 | Bowen | 4/487 |
| 4,765,542 | 8/1988 | Carlson | 5/928 X |
| 4,799,910 | 1/1989 | Kellough | 441/130 X |
| 4,861,301 | 8/1989 | Pomeroy et al. | 441/129 X |

FOREIGN PATENT DOCUMENTS

| | | | |
|---|---|---|---|
| 2240859 | 3/1975 | France | 441/129 |
| 2532907 | 3/1984 | France | 441/129 |

OTHER PUBLICATIONS

Bath-N-Shampoo Brochure, D&B Products, Van Nuys, Calif., (U.S. Pat. No. 4,948,197).

*Primary Examiner*—Charles E. Phillips

[57] ABSTRACT

A recreational floatational device is provided. A horizontally disposed support base has at least one floatation cell. At least one side wall of a shade member extends upwardly from the support base. The shade member further includes a horizontally disposed covering member supported by the at least one side wall. The support base and the shade member have at least one common inflatable air cell, such that full inflation of the air cell forces the side wall and the covering member to assume semirigid positions relative to the base for shading the base. The base has a support surface and perimeter walls extending above the support surface so that the base may retain water on the support surface between the perimeter walls. A water nozzle is further included and held by the covering member in a downwardly facing attitude. A flexible hose is positioned within the at least one air cell, and a hose coupling is positioned on the base. The hose interconnects the water nozzle and the hose coupling so that water may be introduced at the hose coupling to flow through the flexible hose for expulsion from the water nozzle for cooling a person reclining on the support base. A water reservoir is removably attached to the base, and includes a manual spray gun for producing a water spray for further cooling a person reclining on the base.

6 Claims, 1 Drawing Sheet

INFLATABLE RAFT WITH SHOWER

FIELD OF THE INVENTION

This invention relates generally to floatation devices, and, more particularly, to a recreational raft with an integral shower apparatus.

BACKGROUND OF THE INVENTION

Conventional inflatable rafts has been available for many years. Such rafts are generally inflated with air and, if large enough, are able to support even a fairly heavy person on a body of water. Such a raft is typically comprised of a plurality of inflatable cells that form a generally planar support surface. As such, this type of raft is often uncomfortable for use while laying on one's back, or while in a sitting position. Such a raft, therefore, provides little flexibility of use.

Several other types of rafts have been made available to overcome the drawbacks of the conventional raft. For example, a raft device is available that supports a chair structure in a U-shaped floatation portion. While such a device does allow the user to assume a seated position while floating in a stable manner, it does not permit the user to lay down. Thus, such a device is equally inflexible in the way it can be used.

Moreover, while either laying down or sitting, the user of any prior art raft device can quickly become too hot if the device is positioned in direct sunlight or the air temperature is abnormally high. Prior art raft devices offer no means by which to cool the users thereof.

Clearly, a raft device is needed that allows the user to comfortably assume a seated position or a lying down position. Such a device would further include a means for cooling the users thereof, either with water spraying means, sun shading means, or both. Moreover, such a needed device would be able to support a heavy adult person comfortably when such a device is positioned either on a body of water or on the ground. Still further, such a needed device would be able to hold a beverage container without spilling of the beverge, and would be relatively inexpensive to manufacture. The present invention fulfills these needs and provides further related advantages.

SUMMARY OF THE INVENTION

The present invention is a recreational floatational device. A horizontally disposed support base has a floatation means. At least one side wall of a shade means extends upwardly from the support base. The shade means further includes a horizontally disposed covering member supported by the at least one side wall. The position of the covering member provides shading to at least on portion of the support base. The support base and the shade means have at least one common inflatable cell, such that full inflation of the cell forces the side wall and the covering member to assume semirigid positions relative to the base for shading the base. Preferably, the support base further includes at least one identation having an interior surface for holding a beverage container so that a beverage within the container is prevented from being spilled. In one embodiment of the invention, the base has a support surface and perimeter walls extending above the support surface so that the base may retain water on the support surface between the perimeter walls such that a person reclining on the device may be cooled.

A water discharge means is held by the covering member in a downwardly facing attitude. A flexible hose is positioned within the at least one air cell, and a hose coupling is positioned on the base. The hose interconnects the discharge means and the hose coupling so that water may be introduced at the hose coupling to flow through the flexible hose for expulsion from the discharge means for cooling a person reclining on the support base. A control means of the discharge of water from the discharge means is included, the control including producing a mist, a gentle rain, a pulsating shower, a strong shower, and for shutdown of the flow of water from the discharge means. The control means is supported by, and engaged with, the discharge means. A means for hand pumping water from the body of water to the discharge means may be further included. In one embodiment of the invention, a water reservoir is removably attached to the base, and includes a manual spray gun for producing a water spray for cooling a person reclining on the base.

When the cells are inflated with air, the base is able to support an adult while floating on a body of water. When the floatation cells are inflated with water, the base is able to support an adult, the base itself being supported by a firm surface.

The present invention allows the user to comfortably assume a seated position by resting his back against the side walls, or a lying down position. Further, the device includes both a water spraying means and a sun shading means for cooling the users thereof. When the user is in a sitting position, the water discharge means sprays water on the user's back, thereby having a pleasant cooling effect. Moreover, the present invention is able to support a heavy adult person comfortably when the device is positioned either on a body of water or on the ground. Still further, the present invention is able to hold a beverage container without spilling of the beverage, and is relatively inexpensive to manufacture since no aluminum framing or other expensive support means are necessary. Such inexpensive manufacturing, moreover, makes the present invention extremely simple to use. Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawing illustrates the invention. In such drawing.

DETAILED DESCRIPTION OF THE PREFERRED EMBODIMENT

Figure 1:
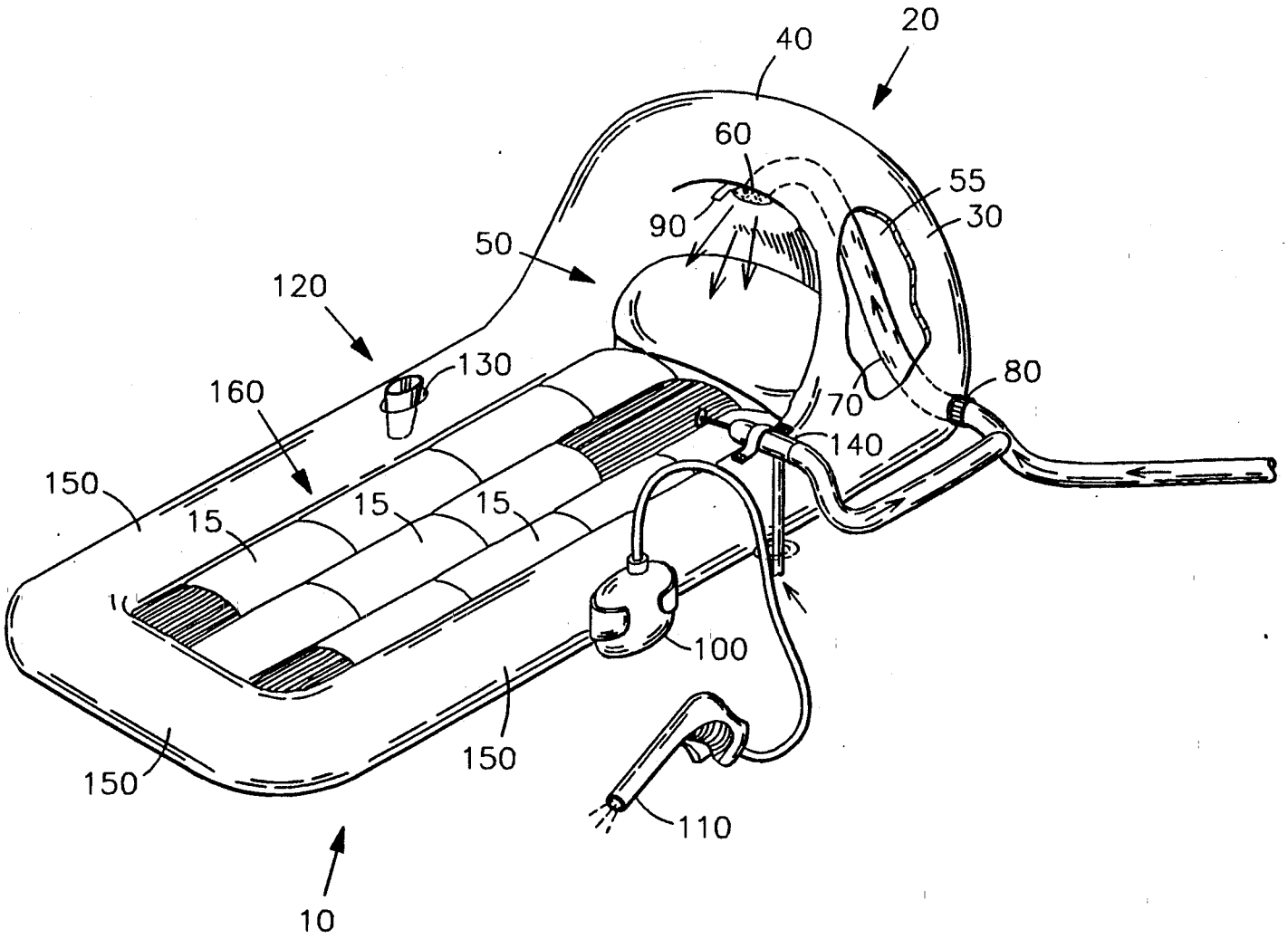
FIG. 1 is a perspective illustration of the invention, showing a support base with a shade means including a water discharge means.

FIG. 1 shows a recreational floatational device. A horizontally disposed support base 10 has a floatation means, such as inflatable floatation cells 15. At least one side wall 30 of a shade means 20 extends upwardly from the support base 10. The shade means 20 further includes a horizontally disposed covering member 40 supported by the at least one side wall 30. The position of the covering member 40 provides shading to at least on portion 50 of the support base 10. The support base 10 and the shade means 20 have at least one common inflatable cell 55, such that full inflation of the cell 55 forces each side wall 30 and the covering member 40 to assume semirigid positions relative to the base 10 for shading the base 10. Preferably, the support base 10 further includes at least one indentation 120 having an interior surface 130 for holding a beverage container so that a beverage within the container is prevented from being spilled. In one embodiment of the invention, the base 10 has a support surface 160 and perimeter walls 150 extending above the support surface 160 so that the base 10 may retain water on the support surface 160 between the perimeter walls 150 such that a person reclining on the device may be cooled. Preferably, the support base 10 and shade means 20 are manufactured with an air tight material, such as rubber or canvass sheet material, that is strong enough to support a heavy adult, while pressurized with air or water, without bursting. A pillow structure may further be included in the shaded portion 50 of the base 10. Moreover, a back support pillow may be further included that fits into the shaded portion 50 of the base 10, under the shading means 20, and supports the back of the user when said user has assumed a sitting position on the device (not shown).

A water discharge means 60 is held by the covering member 40 in a downwardly facing attitude. A flexible hose 70 is positioned within the at least one air cell 55, and a hose coupling 80 is positioned on the base 10. The hose 70 interconnects the discharge means 60 and the hose coupling 80 so that water may be introduced at the hose coupling 80 to flow through the flexible hose 70 for expulsion from the discharge means 60 for cooling a person reclining on the support base 10. A control means 90 of the discharge of water from the discharge means 60 is included, the control 90 including producing a mist, a gentle rain, a pulsating shower, a strong shower, and for shutdown of the flow of water from the discharge means 90. The control means 90 is supported by, and engaged with, the discharge means 60. Clearly, a variety of other spraying types may be produced without significantly changing the spirit or scope of the invention. A hand pumping means 140 for pumping water from the body of water to the discharge means 60 may be further included. In one embodiment of the invention, a water reservoir 100 is removably attached to the base 10, and includes a manual spray gun 110 for producing a water spray for cooling a person reclining on the base 10.

When the inflatable cells 15 and air cell 55 are inflated with air, the base 10 is able to support an adult (not shown) while floating on a body of water. When the inflatable cells 15 are inflated with water, and the air cell 55 is inflated with air, the base 10 is able to support an adult, the base 10 itself being supported by a firm surface (not shown).

While the invention has been described with reference to a preferred embodiment, it is to be clearly understood by those skilled in the art that the invention is not limited thereto. Rather, the scope of the invention is to be interpreted only in conjunction with the appended claims.

We claim:

1. A recreation flotation device, comprising:

a horizontally disposed support base having flotation means;

a shade means having at least one side wall extending upwardly from the support base and a horizontally disposed covering member supported by the at least one side wall in a position above the support base, the position of the covering member being such as to provide sun shading to at least one portion of the support base;

the support base and the shade means having at least one common inflatable cell such that full inflation of the cell forces the side wall and the covering member to assume semirigid positions relative to the base for shading the base;

a water discharge means held by the covering member in a downwardly facing attitude, a flexible hose positioned within the at least one inflatable cell, and a hose coupling positioned on the base, the hose interconnecting the discharge means and the hose coupling so that water may be introduced at the hose coupling to flow through the flexible hose for expulsion from the discharge means for cooling a person reclining on the support base;

whereby when the inflatable cell is inflated with air the base is able to support an adult while floating on a body of water, and when the cell is inflated with water the base is able to support an adult, the base itself being supported by a firm surface.

2. The recreational device of claim 1 wherein the base has a support surface and perimeter walls extending above the support surface so that the base may retain water on the support surface between the perimeter walls, for cooling a person reclining on the device.

3. The recreational device of claim 1 further including a means for control of the discharge of water from the discharge means, the control including producing a mist, a gentle rain, a pulsating shower and a strong shower, and for shutdown of the flow of water from the discharge means, the control means being engaged with the discharge means and supported thereon.

4. The recreational device of claim 1 further including a water reservoir removably attached to the base, and a manual spray gun for producing a water spray for cooling a person reclining on the base.

5. The recreational device of claim 1 further including at least one indentation in the support base for holding a beverage container, the indention having an interior surface for holding the beverage container so that a beverage within the container is prevented from being spilled.

6. The recreational device of claim 1 wherein the device is floating in a body of water, further including a means for hand pumping water from the body of water to the discharge means.

* * * * *